United States Patent [19]

Brink et al.

[11] Patent Number: 4,647,246

[45] Date of Patent: Mar. 3, 1987

[54] VEHICLE TRAP

[75] Inventors: Stuart J. Brink, Catonsville, Md.; Lee Richter, Bethlehem, Ga.

[73] Assignee: International Security Consultants Ltd., Irvington, N.Y.

[21] Appl. No.: 719,372

[22] Filed: Apr. 3, 1985

[51] Int. Cl.[4] ..... E01F 13/00

[52] U.S. Cl. ..... 404/6; 49/33; 49/49; 49/131; 89/1.11; 89/36.04

[58] Field of Search ..... 404/6, 9, 11; 49/33, 49/131, 141; 414/576-584, 362, 368; 109/3, 49.5, 1 R; 43/69; 244/114 B; 89/1.11, 36.01, 36.04

[56] References Cited

U.S. PATENT DOCUMENTS

| | | | |
|---|---|---|---|
| 1,467,183 | 9/1923 | McCullough et al. | 414/362 X |
| 1,555,386 | 9/1925 | Schillinger | 49/33 X |
| 2,741,866 | 4/1956 | Shirley | 43/69 |
| 3,017,146 | 1/1962 | Wagner | 244/114 B |
| 4,332,503 | 6/1982 | Hurst, Jr. | 404/11 |
| 4,367,975 | 1/1983 | Tyers | 404/6 |
| 4,490,068 | 12/1984 | Dickinson | 404/6 |
| 4,554,695 | 11/1985 | Rowland | 404/6 X |

*Primary Examiner*—James A. Leppink
*Assistant Examiner*—Matthew Smith
*Attorney, Agent, or Firm*—Nies, Webner, Kurz & Bergert

[57] ABSTRACT

A pit disposed between an unsecured area and a secured area is normally bridged by a generally flat platform which normally forms a continuation of a roadway. The plate is pivoted at the unsecured side of the pit and is normally supported at the protected side by a weight-responsive removable or frangible support so that an unapproved vehicle will cause the support to give 'way and let the platform swing down and thereby entrap the vehicle in the pit. A plate at the protected side of the pit normally lies in the plane of the platform and functions as an extension thereof. When the weight-responsive support gives 'way and the platform swings down, the plate swings up and forms a blast shield across the path of the force of an explosion of a bomb in the entrapped vehicle. When an approved vehicle is to cross into the secured area a normally inoperative support is engaged with the platform so as to bypass the weight-responsive support.

2 Claims, 4 Drawing Figures

VEHICLE TRAP

BACKGROUND

A new type of warfare, named terrorism, pervades the world. Civilized nations lie at the mercy of fanatics and guerrillas who are willing to blow themselves to bits in order to destroy an embassy, a troop barracks, or a skyscraper office building. Their most insidious weapon thus far is the so-called "car bomb", i.e., an explosive laden vehicle which is driven through a check point or into a barricaded security station so as to get close enough to a building to blow it up, even though the building itself is not breached.

Barricades across a roadway are only partly effective because, in most instances, the roadway must be used to transport goods or personnel to and from a secured area, and if a removable barricade is relied upon, it must have enough mass to withstand the onslaught of a powerful fast-moving vehicle. This very mass, which requires force to move it so as to clear or block a roadway, renders its actions slow and generally requires external power to move it, and a clever intruder may disable the power supply at the very moment it is needed to install the barricade. Draconian measures are needed.

OBJECTS

The primary object of this invention is to provide a weight-responsive vehicle trap which will drop an unapproved vehicle into a pit if an attempt is made to breach an entranceway from an unsecured area to a secured one. Another object is to provide a weight-responsive trap which requires no power, other than the force of gravity to operate it, once the trap is set. Still another object is to provide a normally non-operative means for bypassing the action of the weight-responsive mechanism so as to permit an approved vehicle to pass from an unsecured area to a secured one, but which requires deliberate action to shift it from a non-operative condition to an operative condition.

Because an entrapped vehicle might explode with such force as to damage the secured area, even though the vehicle may be trapped, a particular object of this invention is to provide a normally inoperative shield at the secured end of the trap, which shield is moved to an operative position simultaneously with the dropping of the end of the platform into the pit, and the shield is preferably moved to its operative position by the force of the dropping platform, so that the shield is directed upwardly and a large part of the forces resulting from an exploding bomb in the entrapped vehicle is directed upwardly, rather than horizontally into the secured area.

In keeping with the foregoing general objects, it is intended now to provide a pit intersecting a roadway typically running from an unsecured area to a secured area, an upwardly-open frame in the pit for supporting the platform, and a platform over the upwardly-open part of the frame. Pivots support that end of the platform which is disposed towards the unsecured area whereas shear pins or their equivalents normally support the platform at the secured-end of the pit.

These and other objects will be apparent from the following specification and drawings in which.

Figure 1:
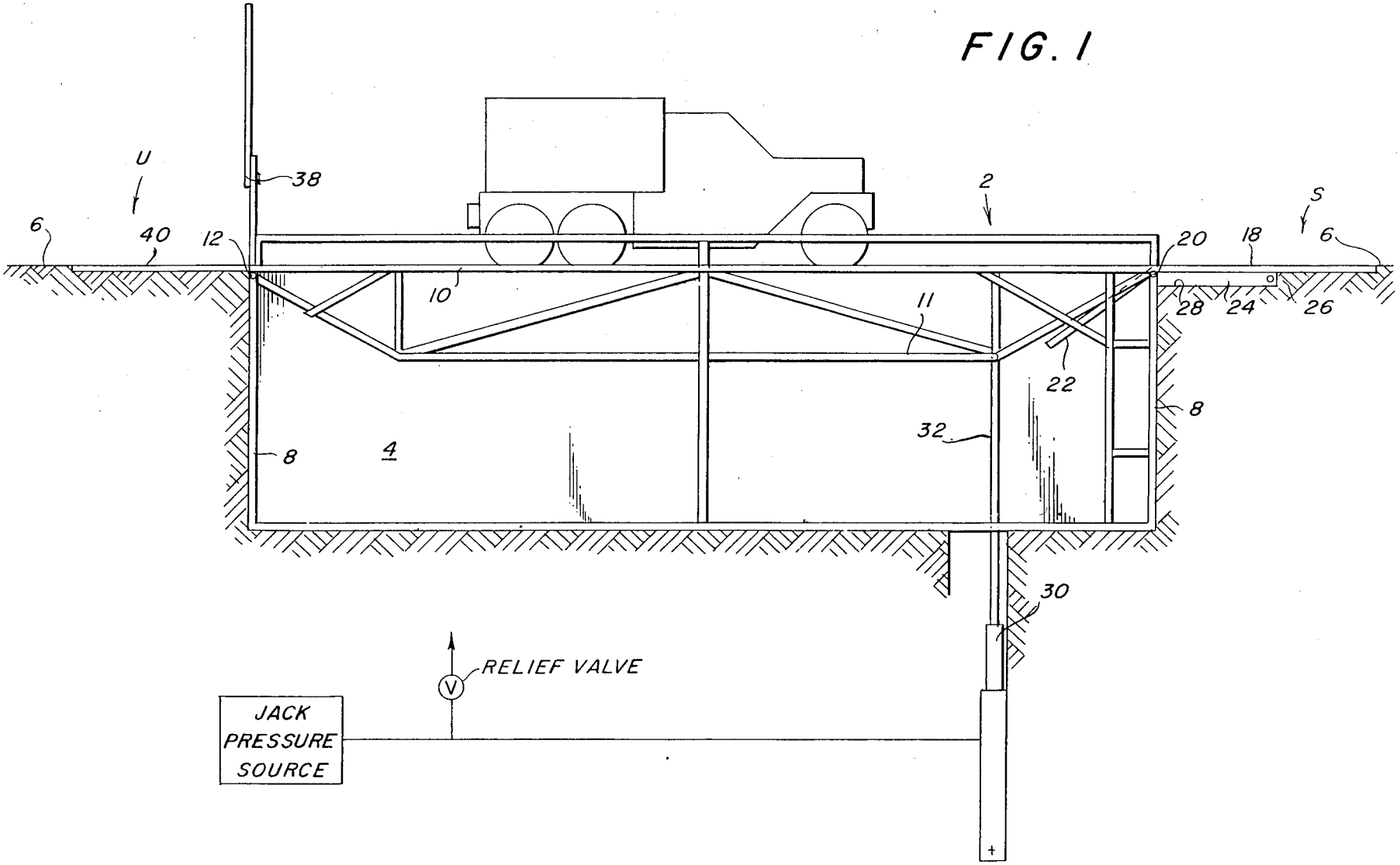
FIG. 1 is a diagramatic section through the terrain adjacent the trap and showing the platform and its associated mechanism positioned to permit an approved vehicle to pass over.

Referring now to the drawings, in which like reference numerals denote similar elements, the vehicle trap 2 is disposed in a pit 4 which intersects a roadway 6 running from an unsecured area U to a secured area S. In pit 4 is an upwardly open frame 8 in which is disposed a platform 10 having suitable rigidifying frame work 11 on its underside. That end of platform 10 which is disposed towards the unsecured area U is supported in frame 8 by hinges 12 whereas the other end, i.e., the end disposed towards the secured area, is normally supported by frangible supports, i.e., shear pins 14 which are designed to break when a predetermined load is imposed upon the end of the platform which is disposed towards the secured area. The load required to break the shear pins can be variously calculated, e.g., the weight of platform 10 and its frame work 11 plus part of the weight of a small automotive vehicle. If desired, the "give 'way" weight can be empirically determined according to whether it is desired to permit a thing greatly lighter than a vehicle, such as a person, to pass over the trap. In order to permit an authorized vehicle to pass over the trap bypass means, i.e., non-frangible pins 16 are provided, it being understood that the bypass means will not give 'way even when a heavy load, such as a loaded trailer truck, is imposed upon the platform. The pins 14 and 16 are manually accessible in wells 15 which may be covered over with a suitable plate, not shown. These are shown diagramatically in FIG. 3. While remotely operated bypass means may be utilized, it is important that the mechanism be maintained in its simpliest form and for this purpose manually operable pins are illustrated in FIGS. 3 and 4.

Figure 2:
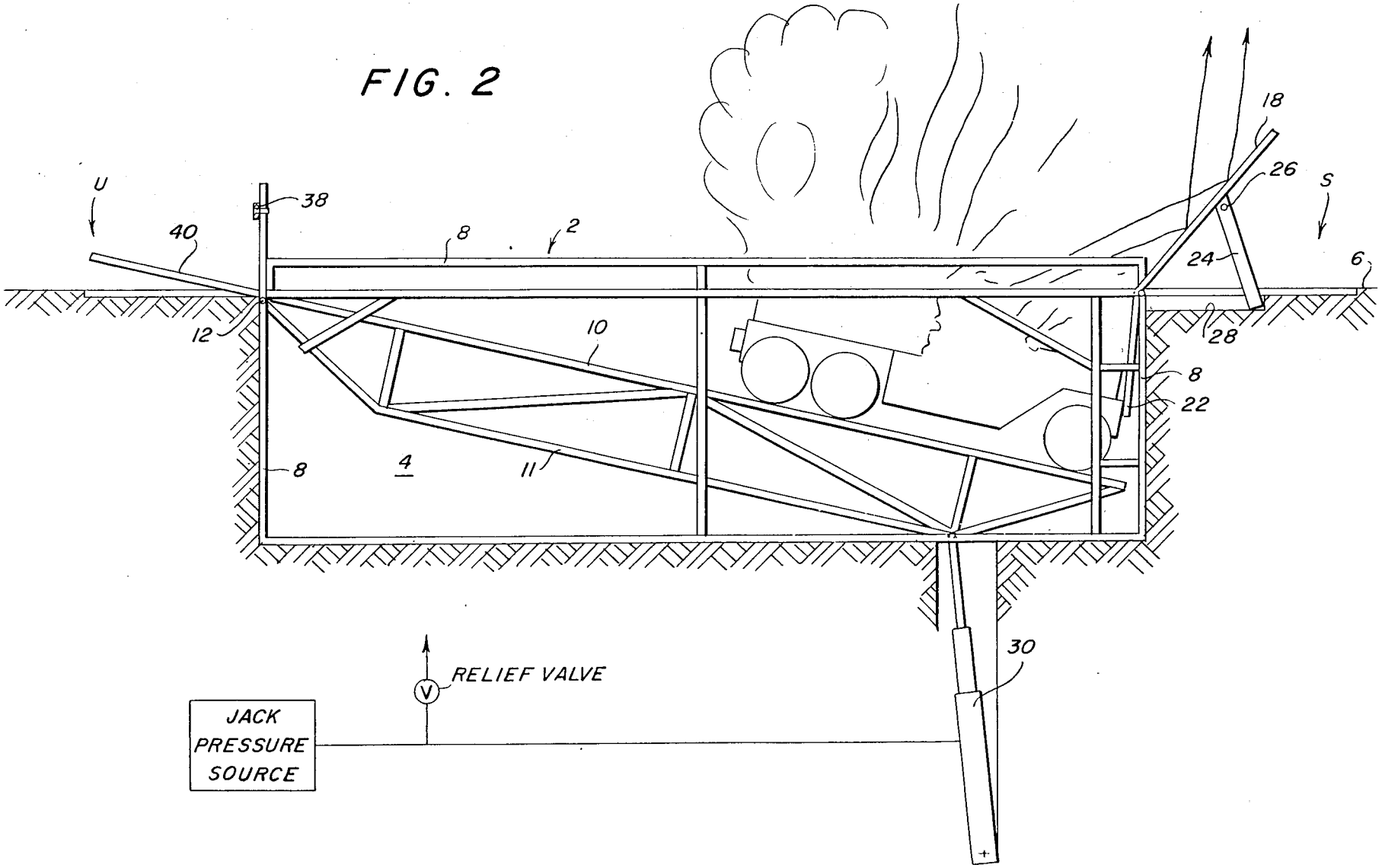
FIG. 2 is a view similar to FIG. 1 but showing an unapproved vehicle entrapped, and diagramatically illustrating explosive forces directed upwardly by the shield.
Figure 3:
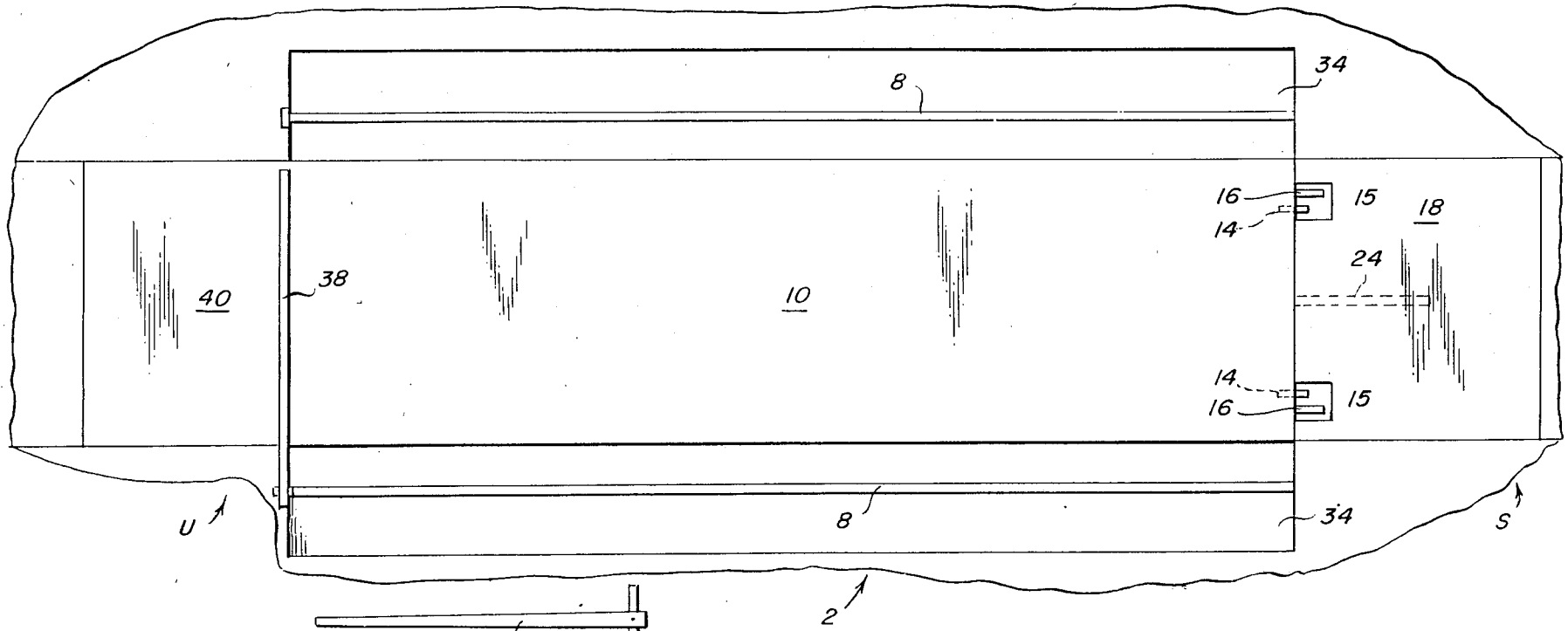
FIG. 3 is a plan view showing the platform in its upper condition.
Figure 4:
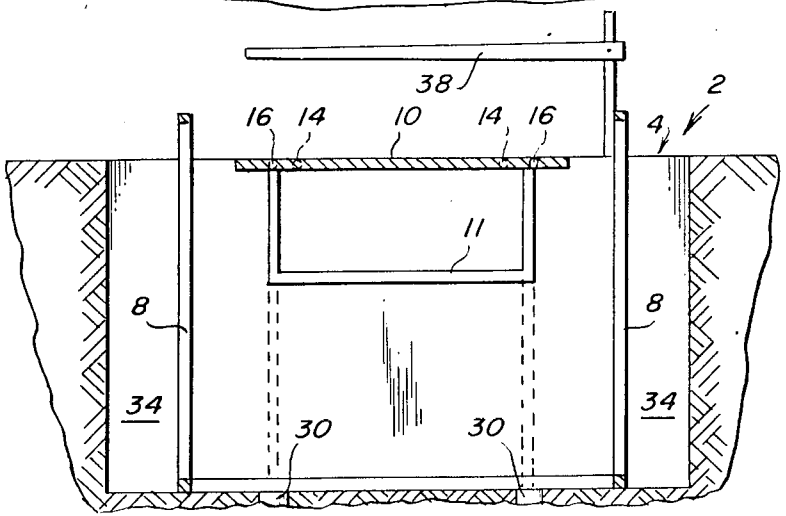
FIG. 4 is a fragmentary cross-section through the trap and the sidewise extension of the pit in which the trap is mounted.

At the secured area side of the trap is mounted a shield plate 18 which normally lies flat into the roadway as shown in FIGS. 1 and 3. Shield plate 18 is attached to the end of frame 8 by a pivot 20, the shield plate having an apron 22 rigidly secured thereto and angling downward into the space beneath the secured area end of the platform 10, it being apparent by comparing FIGS. 1 and 2 that when the frangible support which normally supports the secured area end of the platform gives 'way, and the secured area end of the platform drops, apron 22 is forced down by the dropping platform, thereby flipping shield plate 18 upwardly as shown in FIG. 2. A prop 24 is pivoted as at 26 to the underside of shield plate 18 and is normally accommodated in a recess 28 in the roadway. When shield plate 18 swings up prop 24 swings down and props the shield plate up until the trap is re-set. An extension 40 at the pivoted end of platform 10 swings up (FIG. 2) when the other end of the platform drops, thereby deflecting the blast energy upwardly.

Various means may be provided for elevating platform 10 from its dropped position, the illustrated one being an extensible hydraulic jack 30. In normal operation the ram 32 should be retracted after the shear pins 14 and/or bypass pins 16 are set into platform-supporting positions. Various other arrangements may be made, for example, jack 30 may be provided with a relief valve which is set to blow off at a predetermined pressure to blow out and permit platform 10 to drop upon imposition of a certain load upon the jack; and in such an arrangement it would be possible to dispose of the shear pins, in which case the hydraulic jack would be considered a weight-responsive support. A pressure-responsive relief valve, and an adjustment of the blow-off pressure are diagramatically illustrated in FIGS. 1 and 2. While this alternative arrangements may be made, it is essential that the mechanism be as simple as possible and depend as little as possible upon mechanisms which might get out of adjustment. Preferably the pit is extended on each side of the frame 8, as indicated at 3, to permit access by ladders or suitable hoists to the bottom of the pit.

In operation, platform 10 normally lies in a horizontal position (FIGS. 1, 3 and 4), the shear pins 14 are set in place so as to hold up the platform at the secured area end and the ram 32 of jack 30 is retracted or otherwise rendered nonsupporting. If an unauthorized vehicle attempts to breach the gate 38 at the secured area end of the trap, its weight is imposed upon platform 10, the shear pins will break and the platform 10 drops downwardly as shown in FIG. 2. As the platform drops down, it flips up shield plate 18 to its FIG. 2 position and prop 24 drops down so as to hold the plate up; whereupon the forces resulting from a blast will be deflected upwardly, rather than horizontally into the secured area.

I claim:

1. A vehicle trap adjacent to be disposed in a pit in a roadway running from an unsecured area to a secured area, said trap comprising:

an upwardly open frame having one end disposed towards the unsecured area and an opposite end disposed towards the secured area, a platform having opposite end portions with a surface therebetween normally extending from end-to-end of said frame, hinge means pivotally supporting one end portion of the platform on that end of the frame which is disposed towards the unsecured area, said platform being swingable about the hinge means between a normal horizontal position in which it spans the pit and a tipped-down position in which the surface thereof extends downwardly towards the bottom of the pit and towards the secured area, weight-responsive means engaging between the platform and the frame, said weight-responsive means being characterized in that it supports the platform under loads up to a predetermined amount and that it will give 'way under loads exceeding said predetermined amount, means engageable between the frame and platform for bypassing the weight-responsive means whereby to support said platform under loads exceeding said predetermined amount, a blast-shield plate mounted at the secured end of the frame, said plate being movable between two positions, in a first of which positions said plate being disposed out of a path between the secured end of the frame and at least part of the secured area and a second position in which said plate is disposed across said path, and means responsive to tipping of the platform from the normal horizontal position to the tipped-down position for moving the plate from the first position to the second position.

2. A vehicle trap as claimed in claim 1, said plate being pivotally mounted at the secured end of the framework, said plate being pivotal between the first position in which the plate lies flatwise against the roadway and the second position in which the plate extends upwardly across a path between the downwardly tipped platform and at least part of the secured area.

* * * * *